US006415442B1

(12) United States Patent
Smith

(10) Patent No.: US 6,415,442 B1
(45) Date of Patent: Jul. 9, 2002

(54) INFANT WRAP

(75) Inventor: Brenda M. Smith, Lindon, UT (US)

(73) Assignee: 5@Peace, Inc., Orem, UT (US)

( * ) Notice: Subject to any disclaimer, the term of this patent is extended or adjusted under 35 U.S.C. 154(b) by 0 days.

(21) Appl. No.: 09/721,602

(22) Filed: Nov. 22, 2000

(51) Int. Cl.[7] ..... A41D 11/00
(52) U.S. Cl. ..... 2/69.5; 2/83
(58) Field of Search ..... 2/69.5, 69, 83, 2/88, 80, 75, 111, 123, 124; D2/743

(56) References Cited

U.S. PATENT DOCUMENTS

| | | | | | |
|---|---|---|---|---|---|
| 569,521 | A | * | 10/1896 | Scatchard | |
| 1,701,929 | A | * | 2/1929 | Mettam | |
| 1,802,540 | A | * | 4/1931 | Schmidt | |
| 1,929,263 | A | * | 10/1933 | Sork | 2/114 |
| D127,524 | S | * | 5/1941 | Segerman | |
| 2,989,753 | A | * | 6/1961 | Burner | 2/69.5 |
| 3,872,524 | A | * | 3/1975 | Hummel | 5/334 |
| 4,172,300 | A | * | 10/1979 | Miller | 5/424 |
| 4,202,052 | A | * | 5/1980 | Bilanzich | 2/69.5 |
| 4,507,805 | A | * | 4/1985 | Calutoiu | 2/69.5 |
| 4,674,130 | A | * | 6/1987 | Coudron | 2/69.5 |
| 4,773,101 | A | * | 9/1988 | Kapp et al. | 2/69.5 |
| 5,046,204 | A | * | 9/1991 | Mohler | 5/413 |
| 5,058,226 | A | * | 10/1991 | Crosby | 5/494 |
| 5,418,979 | A | * | 5/1995 | Senderowicz | 2/75 |
| 5,437,061 | A | * | 8/1995 | Kenner | 2/69 |
| 5,535,449 | A | * | 7/1996 | Dickey | 2/69 |
| 5,950,261 | A | * | 9/1999 | Hay et al. | 5/482 |
| 6,145,932 | A | * | 11/2000 | Hamel-Nyhus et al. | 297/465 |

* cited by examiner

*Primary Examiner*—John J. Calvert
*Assistant Examiner*—Alissa L. Hoey
(74) *Attorney, Agent, or Firm*—Angus C. Fox, III

(57) ABSTRACT

An infant wrap having a quadrangular, generally bilaterally symmetrical sheet of fabric material, the sheet having a generally rectangular central region for covering the back side of an infant's torso, overlapping upper and lower flaps attached to first and second opposing sides, respectively, of the central region, and overlapping right and left side flaps attached to third and fourth opposing sides, respectively, of the central region, the flaps providing a covering for the front side of an infant's torso, each flap being continuous with the central region. The sheet further includes a head aperture centered on said sheet's axis of symmetry at the junction of the upper flap and the central region, a pair of leg apertures equally spaced from the axis of symmetry, both feet apertures positioned on the junction of the lower flap and the central region, a pair of arm apertures equally spaced from the axis of symmetry, one arm aperture positioned at the junction of each side flap with the central region, and a sleeve formed from fabric material, attached at one end thereof, to each leg and arm aperture. Each sleeve may incorporate a half cuff, which may be turned inside out in order to cover the sleeve opening. The overlapping flap portions may be equipped with hook and loop fasteners so that the overlapping flap portions may be secured to one another.

20 Claims, 7 Drawing Sheets

INFANT WRAP

BACKGROUND OF THE INVENTION

1. Field of the Invention

This invention relates generally to infant blankets, wraps and buntings and, more particularly, to wraps used for keeping an infant bundled and warm while it is being carried about in a intemperate environment.

2. Description of Related Art

Many types devices for wrapping infants are currently in use. The devices are used both to keep an infant warm to provide a certain level of confinement which reduces the risk of injury to an infant by making it easier to handle and carry.

The simplest type of infant wrap is a rectangular blanket sized for wrapping an infant. Typically, the infant is placed on the open blanket face up, and the lower portion of the blanket is folded over the infant's legs and lower body. The side portions of the blanket are overlappingly folded sideways over the infant. Clips or large safety pins may be used to fasten the folds of the blanket together.

Another type of infant wrap is an adaptation of the "mummy" sleeping bag. U.S. Des. Pat. No. D269,475 discloses such an article. To use such a wrap, the infant is slid into the bag, feet first, or, if the bag is equipped with a longitudinal zipper, the bag is wrapped around the infant and the zipper is closed.

Still another type of infant wrap might be considered a combination of the first two. U.S. Pat. No. 5,046,204 discloses a wrap comprising a sheet of fabric which incorporates a hood, a pair of overlapping side flaps, and a pair of booties, or stocking feet. Hook and loop fasteners are used to secure the flaps. This particular wrap confines the infant, as it is wrapped with its arms folded on its abdomen.

What is needed is an infant wrap which does not confine the arms and legs of the infant, that requires no potentially dangerous safety pins to hold the wrapped portions together, and which provides enhanced flexibility with regard to different conditions of ambient temperature.

SUMMARY OF THE INVENTION

In accordance with the present invention, an infant wrap is provided that includes a quadrangular, generally bilaterally symmetrical sheet of fabric material, the sheet having a generally rectangular central region for covering the back side of an infant's torso. Connected to and continuous with the central region are overlapping upper and lower flaps attached to first and second opposing sides, respectively, of the central region, and overlapping right and left side flaps attached to third and fourth opposing sides, respectively, of the central region. The right and left side flaps wrap around the sides of the infant's torso and also provide a covering for the front side thereof. The upper flap wraps over the infant's shoulders, while the lower flap wraps under the infant's crotch. The upper and lower flaps overlap and also help to cover the front of the infant's torso. The sheet further includes a head aperture centered on said sheet's axis of symmetry at the junction of the upper flap and the central region, a pair of leg apertures equally spaced from the axis of symmetry, both feet apertures positioned on the junction of the lower flap and the central region, a pair of arm apertures equally spaced from the axis of symmetry, one arm aperture positioned at the junction of each side flap with the central region, and a sleeve formed from fabric material, attached at one end thereof, to each leg and arm aperture. Each sleeve may incorporate a half cuff, which may be turned inside out in order to cover the sleeve opening. The overlapping flap portions may be equipped with hook and loop fasteners so that the overlapping flap portions may be secured to one another.

In order to wrap an infant with the invention, an infant's legs are placed through the leg apertures, and its head is placed through the head aperture on the same side of the sheet. Each of the infant's arms is placed through an arm aperture. The lower flap and the upper flap are then folded over on one another on the front of the infant's torso and secured to each other using the hook and loop fasteners which are sewn to the flaps. The side flaps are, likewise, then folded over on one another and secured to each other using the hoop and loop fasteners provided. In warmer weather, the infant's feet and hands may be exposed at the ends of the sleeves, one of which is attached to each of the leg and arm apertures. Each sleeve is equipped with a half cuff, which may be turned inside out, thereby covering the end of the sleeve and protecting the infant's extremities in more inclement weather.

PREFERRED EMBODIMENT OF THE INVENTION

Figure 1:
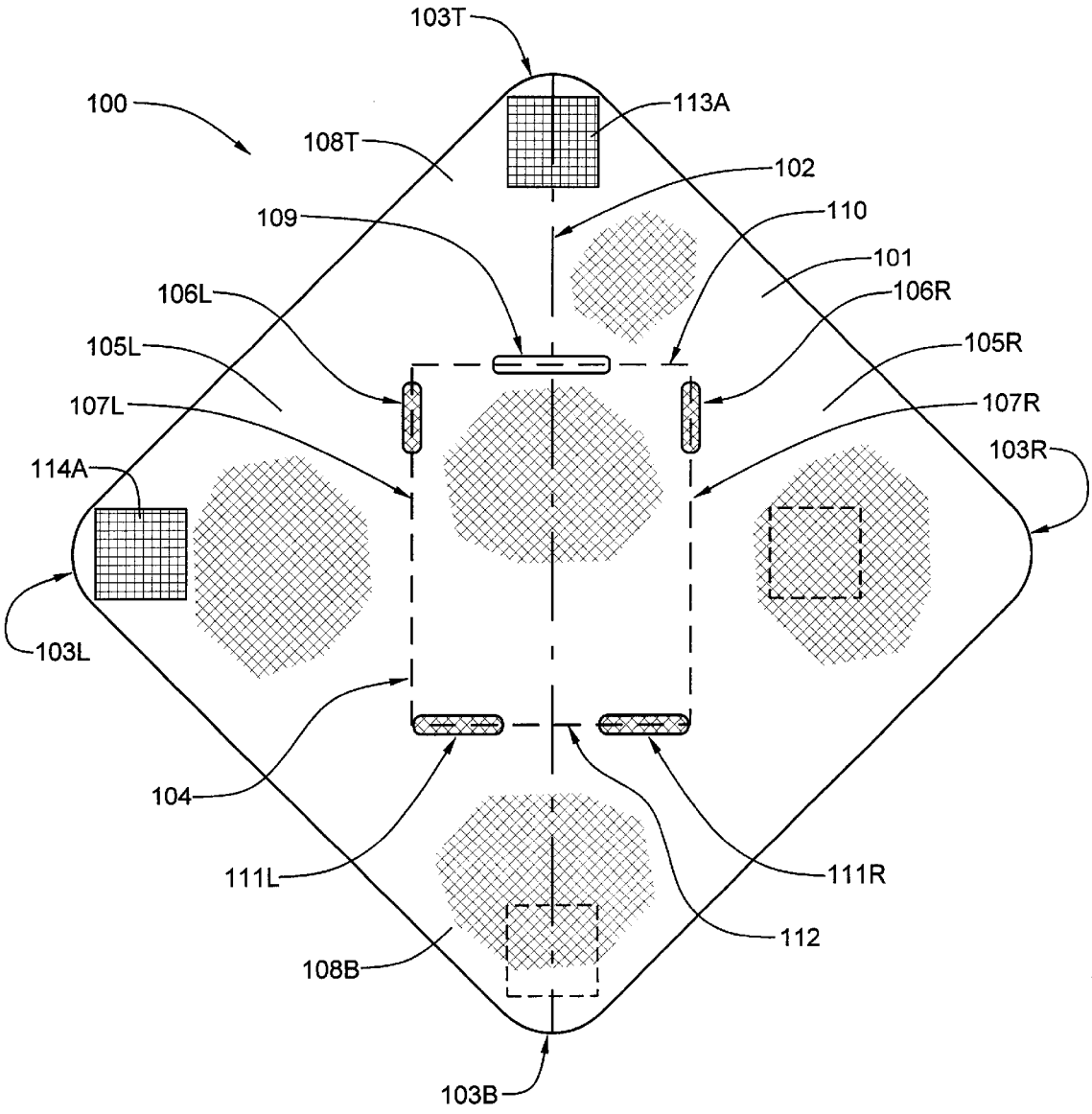
FIG. 1 is a front elevational view of the infant wrap manufactured in accordance with the present invention.
Figure 2:
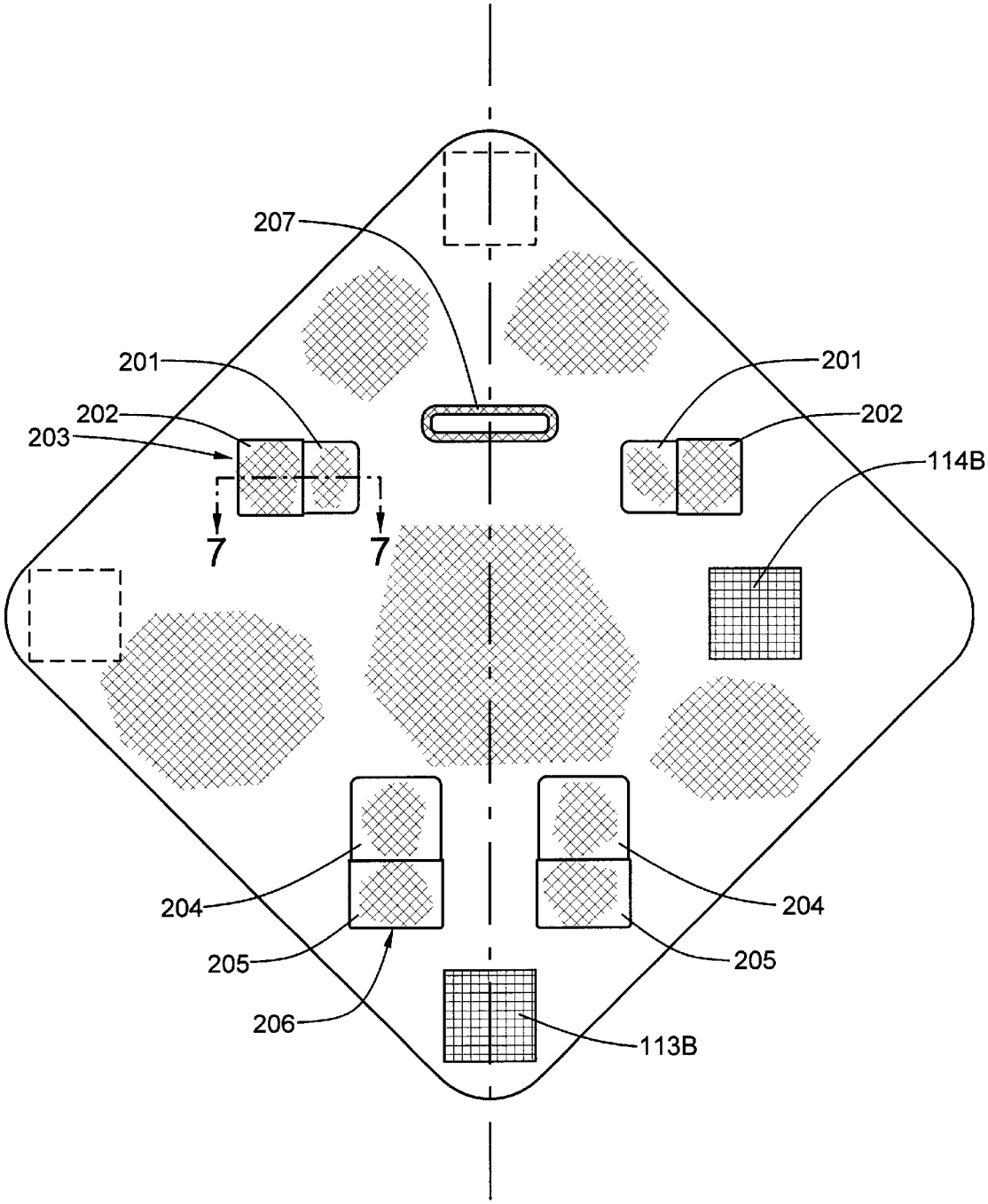
FIG. 2 is a rear elevational view of the infant wrap of FIG. 1.

The inside and outside of an infant wrap 100, produced in accordance with the present invention, are shown in FIGS. 1 and 2, respectively. The wrap 100 includes a generally square sheet of fabric material 101 having a principal diagonal 102 with which the spine of an infant (not shown in this view) is alignable for proper wrapping of the infant therein. The fabric material for sheet 101 may be blanket cloth, quilting, mattress padding, heavy-weight flannel or fleece material woven from natural or synthetic fibers. The sheet 101 may be equipped with rounded corners 103L, 103T, 103R, and 103B. The sheet of fabric material 101, which is constructed of a material selected from the group of materials consisting of blanket material, bunting, quilting, and combinations thereof, has a generally rectangular central region 104, which is sized to cover the cover principally cover the back of an infant's torso. The sheet 101 also includes a pair of opposed right and left lateral corner portions 105L and 105R, respectively, each of which adjoins and is continuous with the central rectangular region 104. The sheet 101 also includes a pair of arm apertures, 106L and 106R, which are equally spaced from the principal diagonal 102. The left arm aperture 106L is positioned along a junction 107L between the left lateral corner portion 105L and the central rectangular region 104. Likewise, the right arm aperture 106R is positioned along a junction 107R between the right lateral corner portion 105R and the central rectangular region 104. The sheet 101 also includes a pair of opposed top and bottom longitudinal corner portions 108T and 108B, each of which adjoins and is continuous with the central rectangular region 104. A head opening 109 is positioned on the midpoint of a junction 110 between the top longitudinal corner portion 108T and the central rectangular region 104. In addition, a of leg apertures 111L and 111R are positioned along a junction 112 between the bottom longitudinal corner portion 108B and the central rectangular region 104, equidistantly spaced from the principal diagonal.

In order to wrap an infant in the wrap 100, the infant's arms are inserted through arm apertures 106L and 106R, the infant's legs are inserted through the leg apertures 111L and 111R, and the infant's head is inserted through the head opening 109. The lateral corner portions 105L and 105R are folded towards one another in a partially overlapping configuration, thereby wrapping around the torso of the infant, after which the longitudinal corner portions 108T and 108B are folded towards one another in a partially overlapping configuration, thereby wrapping over the infant's shoulders and crotch, respectively. Alternatively, the longitudinal corner portions 108T and 108B may be folded towards one another and partially overlapped first, followed by a folding and partial overlapping of the lateral corner portions 105L and 105R. The opposed longitudinal corner portions, 108T and 108B, are equipped with hook and loop fastener patches 113A and 113B, which are preferably sewn to the sheet 101, so that the overlapping regions of those corner portions may be secured to one another. Likewise, the opposed lateral corner portions, 105L and 105R, are also equipped with hook and loop fastener patches 114A and 114B, so that overlapping regions of those corner portions may be secured to one another. One having ordinary skill in the art of clothing manufacture will recognize that other fastening means, such as buttons, snaps and belts may be used to secure the overlapping corner portions 108T/108B and 105L/105R. In addition, the hook and loop fastener patches may be secured to the sheet 101 through other means, such as with adhesives.

Referring now, specifically, to FIG. 2, an arm sleeve 201 is attached to each of the arm apertures 106L and 106R, and a leg sleeve 202 is attached to each of the leg apertures 111L and 111R. For a preferred embodiment of the invention, each sleeve is made from stretch knit fabric, such as ribbed cotton, nylon or polyester knit. The stretchable nature of the sleeves aids in minimizing heat loss due to drafts. Also for a preferred embodiment of the invention, each of the sleeves 101 and 202 incorporates a half cuff 203, which can be turned inside out in order to cover the sleeve opening 204 at the unattached end of the sleeve. The head opening 108 is ringed with a band of stretch material, also in the interest of minimizing heat loss from the infant's body.

Figure 3:
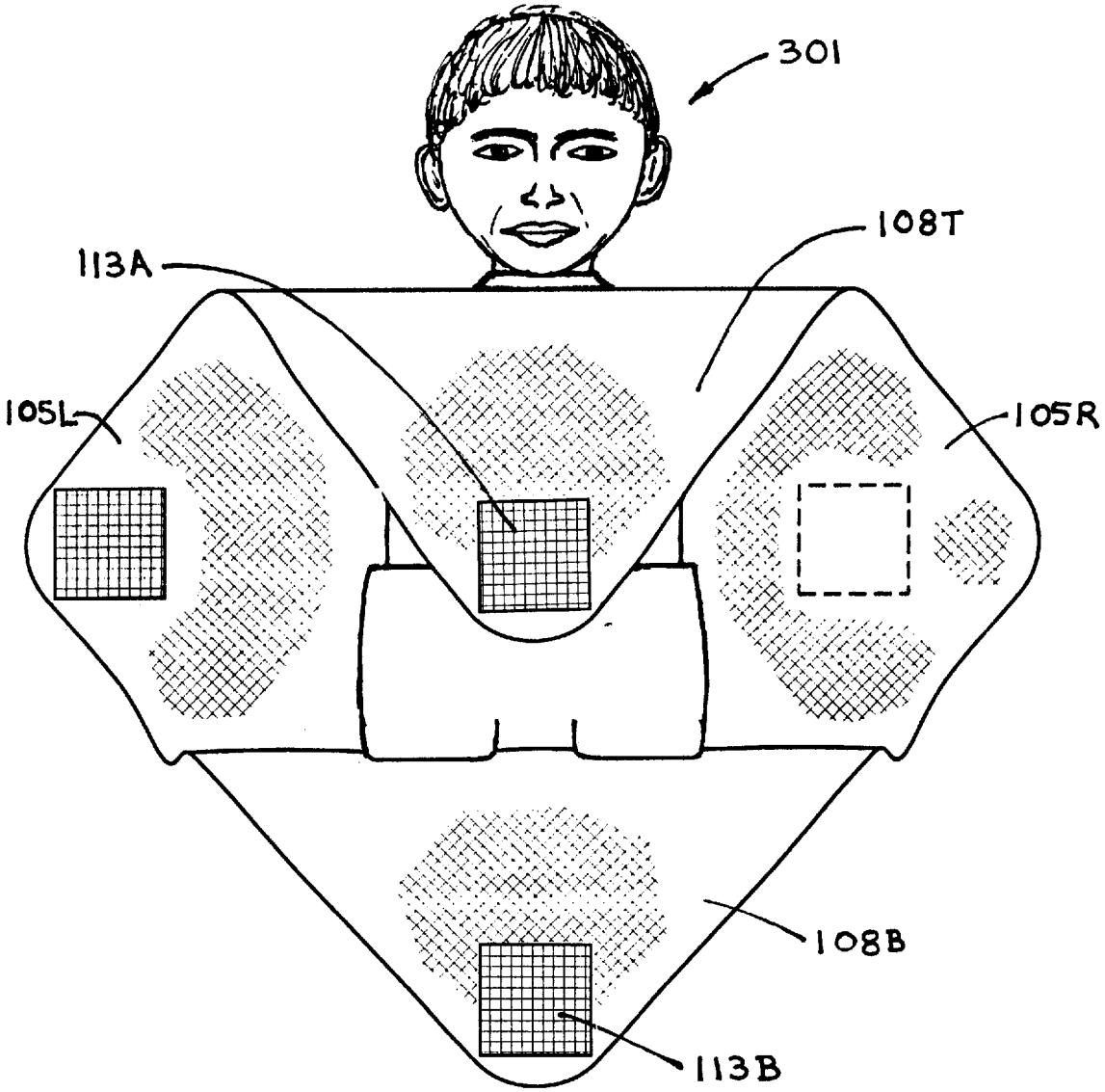
FIG. 3 is a front elevational view of the wrap and of an infant having its arms, legs and head inserted through the respective apertures of the wrap and with the top flap folded downwardly on the infant's chest.
Figure 4:
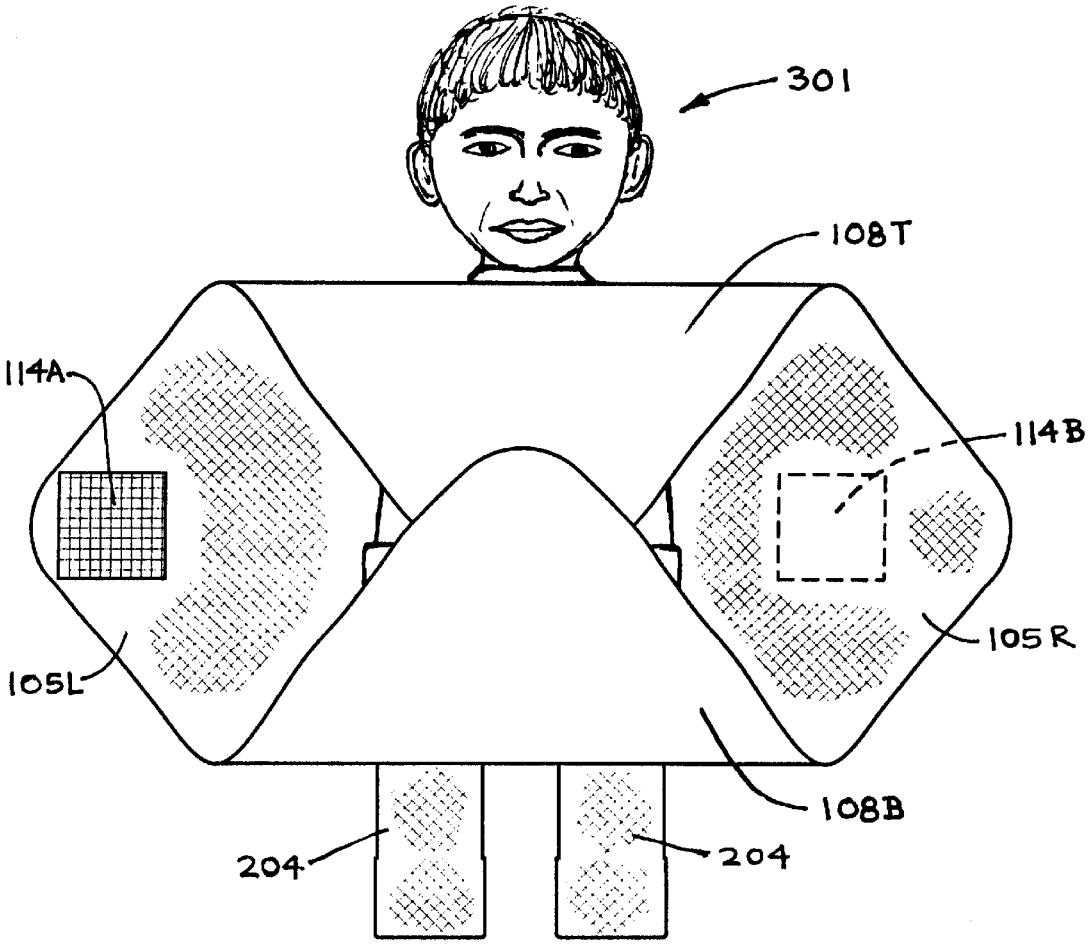
FIG. 4 is a front elevational view of the infant and infant wrap of FIG. 3 following the upward folding of the bottom flap to overlap a portion of the top flap.

Referring now to FIG. 3, an infant 301 has its arms, legs and head respectively inserted through apertures 106L, 106R, 111L, 111R and 109 of the wrap 100 and with the top flap 108T folded downwardly on the infant's chest;

Referring now to FIG. 4, the bottom flap 108B has been folded upwardly so as to overlap a portion of the top flap 108T and secure hook and loop fasteners pads 113A and 113B together.

Figure 5:
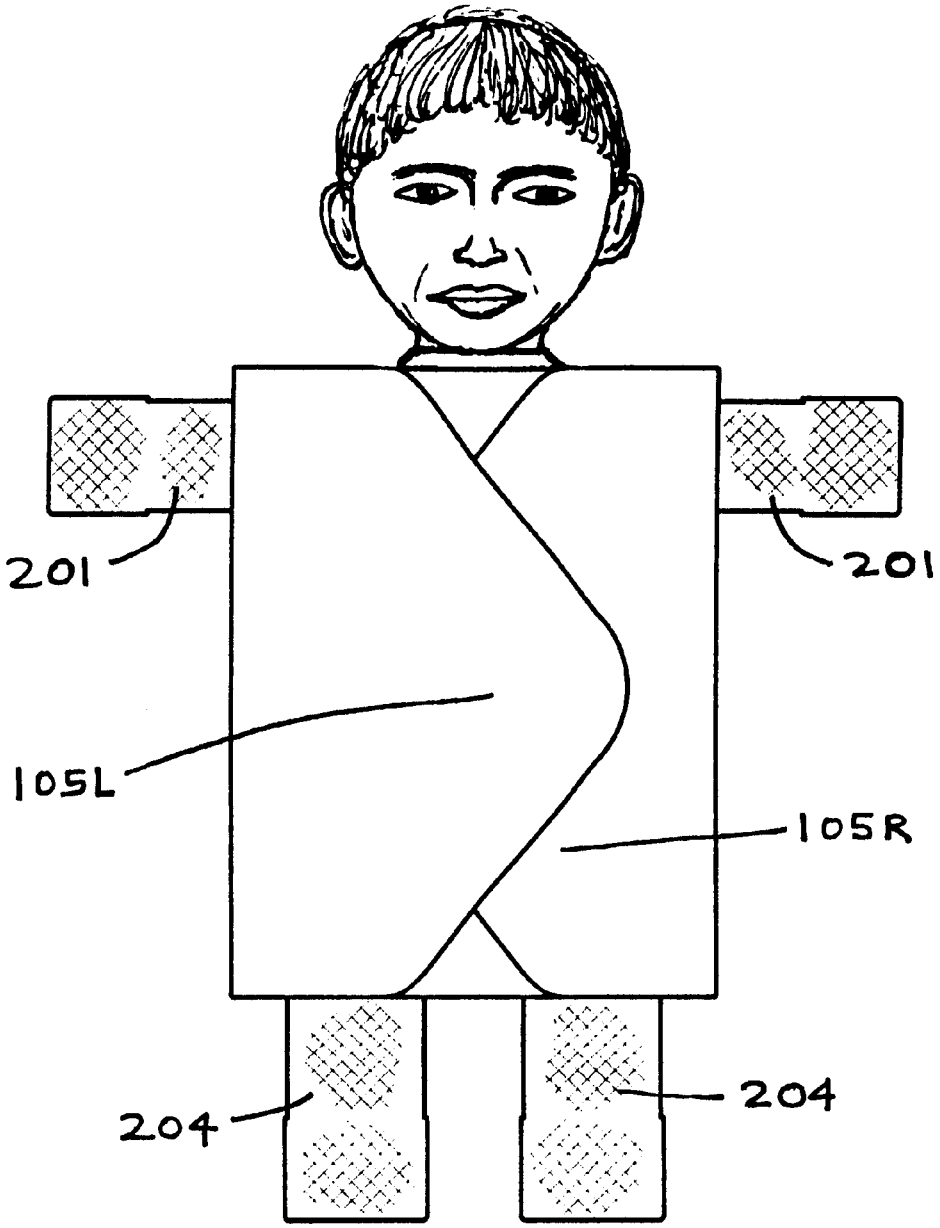
FIG. 5 is a front elevational view of the infant and infant wrap of FIG. 4 following the partial overlapping of the side flaps on the infant's chest.

Referring now to FIG. 5, the side flap 105R has been wrapped over the infant's chest and side flap 105L has also been wrapped over the infant's chest so that it partially overlaps the right flap 105R and brings hook and loop fastener pads 114A and 114B together.

Figure 6:
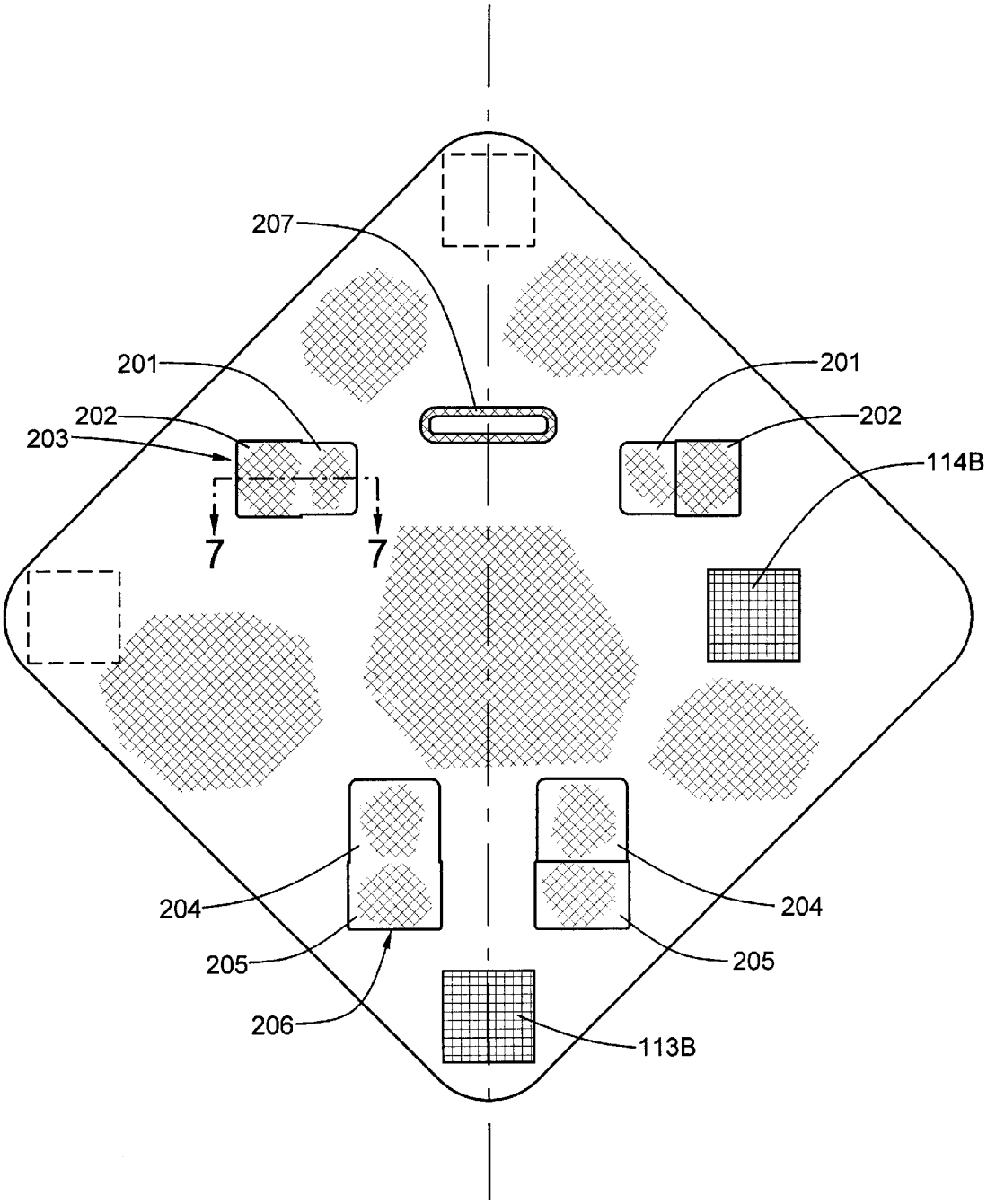
FIG. 6 is a rear elevational view of the infant wrap of FIG. 1 with the half cuff of the left arm sleeve and the half cuff of the left leg sleeve turned inside out in order to cover the respective sleeve opening.

Referring now to FIG. 6, the half cuff 202 of the left arm sleeve 201 and the half cuff 205 of the left leg sleeve 204 have been turned inside out so as to cover the respective openings 203 and 206.

Figure 7:
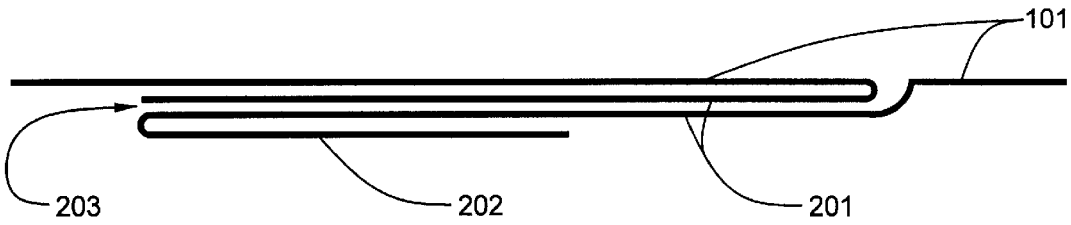
FIG. 7 is a cross sectional view through the left arm sleeve through section line 7—7 of FIG. 2.
Figure 8:
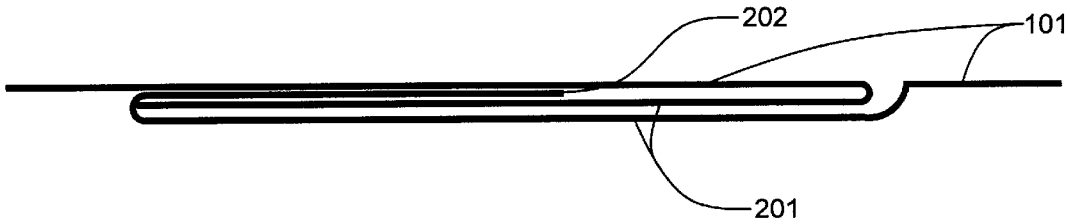
FIG. 8 is a cross-sectional view through the right arm sleeve through section line 8—8 of FIG. 6.

Referring now to FIG. 7, the half cuff 202 of the left sleeve of FIG. 2 is shown in the sleeve open position. In FIG. 8, the half cuff 202 of the same sleeve has been turned inside out to close the sleeve opening.

Although only a single embodiment of the infant wrap is disclosed herein, it will be obvious to those having ordinary skill in the art that changes and modifications may be made thereto without departing from the scope and the spirit of the invention as hereinafter claimed.

What is claimed is:

1. An infant wrap comprising a generally square sheet of fabric material having a principal diagonal with which the spine of an infant is alignable for proper wrapping thereof, said sheet having:

a generally rectangular central region for principally covering the back of the infant's torso;

a pair of opposed right and left lateral corner portions, each of which adjoins and is continuous with the central rectangular region;

a pair of arm apertures equally spaced from the principal diagonal, one arm aperture positioned along a junction of each lateral corner portion with the central rectangular region;

a pair of opposed top and bottom longitudinal corner portions, each of which adjoins and is continuous with the central rectangular region;

a head aperture centered on the midpoint of a junction between the top longitudinal corner portion and the central rectangular region;

a pair of leg apertures equally spaced from the principal diagonal, both leg apertures positioned along a junction between the bottom longitudinal corner portion and the central rectangular region;

whereby, with the infant's arms inserted through arm apertures, said lateral corner portions may be folded towards one another in a partially overlapping configuration, thereby wrapping around the torso of the infant and, with the infant's head inserted through the head aperture and legs inserted through the leg apertures, said longitudinal corner portions may be folded towards one another in a partially overlapping configuration, thereby wrapping over the infant's shoulders and crotch, respectively.

2. The infant wrap of claim 1, wherein each of at least two of the sleeves incorporates a half cuff which can be turned inside out in order to cover the sleeve opening at the unattached end thereof.

3. The infant wrap of claim 1, wherein said sheet is constructed of a material selected from the group of materials consisting of blanket material, bunting, quilting, and combinations thereof.

4. The infant wrap of claim 1, wherein overlapping flap portions are equipped with hook and loop fasteners so that the overlapping flap portions may be secured to one another.

5. The infant wrap of claim 1, wherein each of said sleeves is constructed of stretch material.

6. The infant wrap of claim 1, wherein said head aperture is ringed with a band of stretch material.

7. The infant wrap of claim 1, wherein each corner of the generally square sheet of fabric material is rounded.

8. An infant wrap comprising a generally bilaterally symmetrical sheet of fabric material, said sheet having:

a generally rectangular central region;

an upper flap adjoining and continuous with an upper edge of said central region;

a lower flap adjoining and continuous with a lower edge of said central region;

a left side flap adjoining and continuous with a left edge of said central region;

a right side flap adjoining and continuous with a right edge of said central region;

a head aperture centered on a junction between the upper flap and the central region;

a pair of spaced-apart leg apertures positioned on a junction between the lower flap and the central region;

a right arm aperture positioned on a junction between the right side flap and the central region;

a left arm aperture positioned on a junction between the left side flap and the central region;

a sleeve formed from fabric material, attached at one end thereof, to each leg and arm aperture; and whereby with an infant positioned on the sheet with its head, arms and legs inserted through the respective apertures, the right and left flaps may be folded towards one another in a partially overlapping configuration, thereby wrapping around the torso of the infant, and the upper and lower flaps may also be folded towards one another in a partially overlapping configuration, thereby wrapping over the infant's shoulders and crotch, respectively.

9. The infant wrap of claim 8, wherein each of at least two of the sleeves incorporates a half cuff which can be turned inside out in order to cover the sleeve opening at the unattached end thereof.

10. The infant wrap of claim 8, wherein said sheet is constructed of a material selected from the group of materials consisting of blanket material, bunting, quilting, and combinations thereof.

11. The infant wrap of claim 8, wherein overlapping flap portions are equipped with hook and loop fasteners so that the overlapping flap portions may be secured to one another.

12. The infant wrap of claim 8, wherein each of said sleeves is constructed of stretch material.

13. The infant wrap of claim 8, wherein said head aperture is ringed with a band of stretch material.

14. The infant wrap of claim 8, wherein said sheet is quadrangle.

15. The infant wrap of claim 14, wherein said quadrangle is a square.

16. The infant wrap of claim 15, wherein each corner of the square sheet is rounded.

17. An infant wrap comprising:

a quadrangular, generally bilaterally symmetrical sheet of fabric material having an axis of symmetry, said sheet having a generally rectangular central region for covering the back side of an infant's torso, overlapping upper and lower flaps adjoining and continuous with first and second opposing sides, respectively, of said central region, and overlapping right and left side flaps adjoining and continuous with third and fourth opposing sides, respectively, of said central region, said flaps providing a covering for principally the front side of an infant's torso, each flap being continuous with said central region;

a head aperture centered on the axis of symmetry at the junction of said upper flap and said central region;

a pair of leg apertures equally spaced from the axis of symmetry, both feet apertures positioned on the junction of said lower flap and said central region;

a pair of arm apertures equally spaced from the axis of symmetry, one arm aperture positioned at the junction of each side flap with said central region; and a sleeve formed from fabric material, attached at one end thereof, to each leg and arm aperture.

18. The infant wrap of claim 17, wherein each of at least two of the sleeves incorporates a half cuff which can be turned inside out in order to cover the sleeve opening at the unattached end thereof.

19. The infant wrap of claim 17, wherein said sheet is constructed of a material selected from the group of materials consisting of blanket material, bunting, quilting, and combinations thereof.

20. The infant wrap of claim 17, wherein overlapping flap portions are equipped with hook and loop fasteners so that the overlapping flap portions may be secured to one another.

* * * * *